United States Patent [19]

Seaich

[11] 4,263,758

[45] Apr. 28, 1981

[54] CLUSTERED GEODESIC STRUCTURES

[76] Inventor: David E. Seaich, Box 63, Huntsville, Utah 84317

[21] Appl. No.: 72,562

[22] Filed: Sep. 4, 1979

[51] Int. Cl.[3] ..... E04B 1/32

[52] U.S. Cl. ..... 52/81; 52/DIG. 10

[58] Field of Search ..... 52/81, 80, 82, DIG. 10

[56] References Cited

U.S. PATENT DOCUMENTS

| | | | |
|---|---|---|---|
| 3,359,694 | 12/1967 | Hein | 52/81 |
| 3,660,952 | 5/1972 | Wilson | 52/81 |
| 3,854,255 | 12/1974 | Baker | 52/81 |
| 3,925,940 | 12/1975 | O'Connell et al. | 52/81 |

FOREIGN PATENT DOCUMENTS

| | | | |
|---|---|---|---|
| 1328631 | 8/1973 | United Kingdom | 52/81 |

*Primary Examiner*—J. Karl Bell

[57] ABSTRACT

A primary geodesic type building, comprising five subassembly units, including an uppermost regular octagonal roof unit supported on alternate edges by four identical regular hexagonal units in quadripod fashion to form a generally hemispherical space capturing structure, spaces between the hexagonal units being closed by four square panels and four isoceles trapezoids. Said structure may be supported on upstanding flat wall units, to form a building of greater height having a substantially square shape to efficiently capture space therein. Said buildings may be connected directly or by suitable connecting structures, which may include a geodesic type roof comprising fifteen identical isoceles triangular panels connected at their leg edges to form a ridged structure having an equilateral regular pentagonal base.

6 Claims, 15 Drawing Figures

CLUSTERED GEODESIC STRUCTURES

BACKGROUND OF THE INVENTION

1. Field of the Invention

The invention is in the field of shell structures and more particularly those having geodesic domes.

2. Prior Art

The general geodesic type building has been previously often used, and offers many known advantages: high strength to weight ratio (high load capacity), stability under wind and earthquakes, attractive ratio of volume to surface (material savings), ease of heating and cooling because of fewer dead corner spaces, unobstructed head room because of lack of need for trusses and the like, and in some designs panellized construction attachable with minimum labor.

Many prior designs, however, are of restricted use because of shortcomings in design, engineering and required methods of construction, in that: excess technical complexity prevents many from building such designs; many prior methods and necessary devices for erection are too complex and costly; many designs do not lend themselves to inexpensive rapid mass production because multiple shapes an sizes of basic components are utilized which do not cut well from rectangular stock resulting in waste of material, the designs not being adapted to fabrication from standard lumber, plywood or other building material; many prior domes have ten, twelve, fourteen or more angles in the base, making them difficult to lay out and rendering foundations and walls difficult to construct because triangular bases are utilized; prior domes consisting entirely of triangles do not allow the ready installation of dormers to accommodate standard windows, so that custom made windows often of triangular shape must be used and are difficult to seal and expensive; and even ground level doors and windows are difficult to construct and may require the removal of load bearing struts from the dome system thereby weakening the structures.

To eliminate or minimize the foregoing disadvantages of the prior art, there is a need for a more simple structure involving a minimum number of basic dome elements, and the resulting structure should be substantially quadrate in shape. The elimination of as many as possible of the angles of attachment of the components forming the roof and walls is needed, and this results from the quadrate design of this invention. There is also a need for economical and esthetically pleasing structures to connect the domed building into clusters for larger dwellings and the like, and such connecting structures are generally more appropriate if being also of geodesic dome type, as provided by this invention.

BRIEF SUMMARY OF THE INVENTION

The invention comprises a primary building of geodesic type comprised of five sub-assembly units, one of which units constitutes a roof and the other four being disposed in quadripod fashion to support the roof and together therewith comprise a generally hemispherical space capturing structure. The upper portions of the spaces between the four hexagonal units are closed by four identical square, preformed, ordinarily flat, panels. The apex or roof unit may be comprised of eight identical triangular panels. The hexagonal units may be each comprised of six identical triangular panels. All triangular panels are isosceles and apices of either triangles in the hexagon or octagon may be at a common point removed from the common plane of the bases of the triangles so that the units are dished. All the panels are peripherally bevelled for ease and stability of interconnection, and the building is completely prefabricated. Thus, the building is constructed from elements of only two basic shapes, namely, an isosceles triangle and a square, the triangles in the hexagon being identical and the triangles in the octagon being identical. The hexagonal and octagonal triangles vary only in the length of the sides, the bases of all triangles being equal in length. The primary building may also comprise upstanding flat wall units supporting the geodesic dome. A secondary building, which may be of partially geodesic type, is used as a connector between two geodesic domes of the above type to cluster the primary structures, and may be comprised of three sub-assembly units which comprise a roof. The center geodesic section is self supporting, requiring no truses, and is comprised of fifeteen identical triangular components which when connected is pairs form diamond shaped units which are folded into a V shape. These diamond shaped components are arranged in a five pointed star pattern which forms a pentagon shaped base, three sides of which rest on flat, vertical walls. The other two sub-assembly roof units are of standard framing comprising joists on a central beam and the upper edges of flat vertical walls.

It is the object of this invention to provide domed structures which eliminate or minimize the previously stated disadvantages of the prior art by requiring fewer component units of readily fabricated shapes adapted for fabrication readily from standard building stock materials to achieve a generally quadrate geodesic building compatible with the use of standard door and window units. Other objects and advantages of the invention will be apparent from the following detailed description of the presently preferred embodiment.

DETAILED DESCRIPTION OF ILLUSTRATED EMBODIMENT

Figure 1:
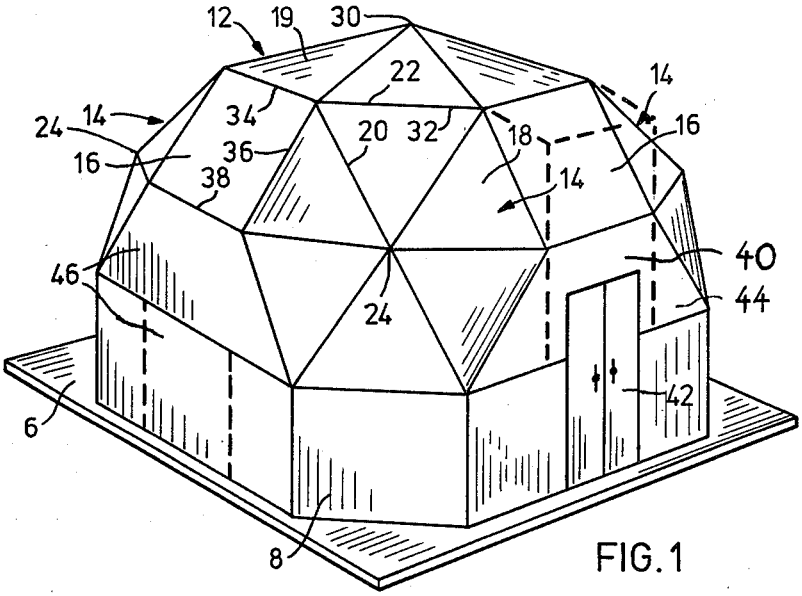
FIG. 1 is a perspective view of a primary building structure according to this invention.
Figure 6:
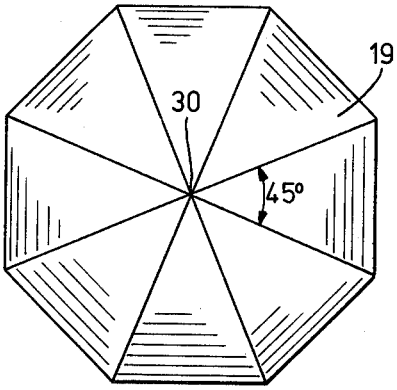
FIG. 6 is a top plan view of an octagonal sub-assembly unit.
Figure 7:
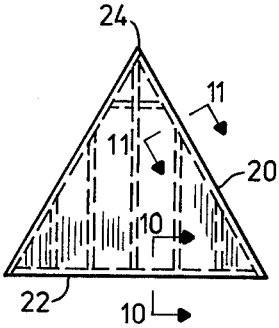
FIG. 7 is an enlarged view of a typical triangular panel used in the hexagonal sub-assembly unit.
Figure 8:
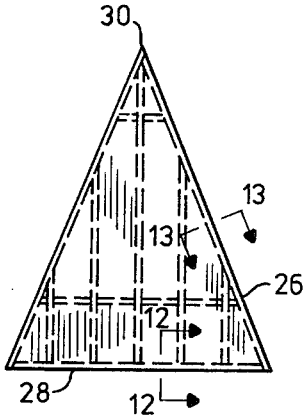
FIG. 8 is an enlarged view of a typical triangular panel used in the octagonal sub-assembly unit.
Figure 9:
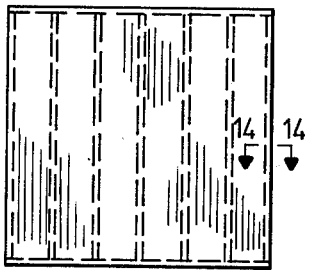
FIG. 9 is an enlarged view of a typical square panel.
Figure 10:
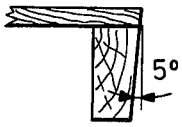
FIG. 10 is an enlarged sectional view taken on line 10—10 of FIG. 7.
Figure 11:
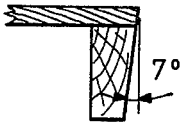
FIG. 11 is an enlarged sectional view taken on line 11—11 of FIG. 7.
Figure 12:
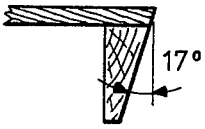
FIG. 12 is an enlarged sectional view taken on line 12—12 of FIG. 8.
Figure 14:
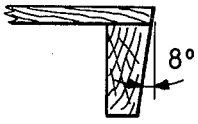
FIG. 14 is an enlarged sectional view taken on line 14—14 of FIG. 9.
Figure 13:
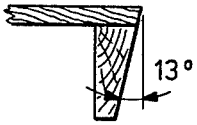
FIG. 13 is an enlarged sectional view taken on line 13—13 of FIG. 8.
Figure 15:
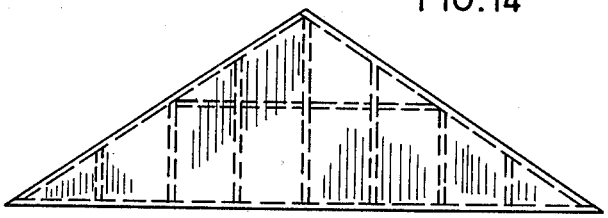
FIG. 15 is an enlarged view of a typical triangular panel used in the pentagonal sub-assembly unit.

As seen in FIG. 1, a primary building 1 is of general geodesic type, being substantially self-supporting dome type shells of generally hemispherical shape, comprised of triangles of various shapes and squares 16, that are ordinarily supported on vertical riser walls 8 secured to a slab 6 or equivalent flat base. The primary building is constructed of four identical hexagonal sub-assembly units 14, one roof unit 12 and four identical preformed panels 16 which are square. Each of said hexagonal units is a subassembly of six identical triangular panels 18 having equal sides 20, bases 22, and with apices 24 at a common point removed from the common plane of the bases 22, so that the hexagonal units are dished. The octagonal roof unit 12 is a sub-assembly of eight identical triangular panels 19, having equal sides 26, bases 28 and apices 30 at a common point removed from the common plane of the bases 28 so that the octagonal unit 12 is dished, FIG. 6.

The bases 22 will be referred to herein alternatively as the edges of the hexagonal and octagonal units. The upper edges of the hexagonal units 14 are secured to alternate edges of the roof unit 12 as at 32, FIG. 1. The square panels 16 have upper edges 34, each of a length equal to the bases 22, and the sides 36 of the squares are equal in length with the bases 22 and 28 of the triangular panels, enabling the interconnection of bases 22 and 28 with sides 36 and 34 of the square panel. The lower edges 38 of the squares 16 define headers for possible access openings 40 for the building, illustrated in dashed lines in FIG. 1. These openings may be closed as by doors 42, which may be sliding or hinged as desired, flanked by any suitable wall panels 44. The doors and wall panels, if desired, are ordinarily vertical and may vary considerably while remaining complementary to the general quadripod arrangement of the hexagonal sub-assembly wall units 14.

The openings 46 can be made to accommodate windows or be closed for non-access by solid panels such as diagrammatically indicated at 40, 42, and 44 in FIG. 1. Again, such engineering treatment of the openings 46 is conceived as complementary rather than elemental in relation to the invention. Other details or design could be used at the individual designers discretion. Internal bracing, FIGS. 7,8,9, & 15, as well as the angles of bevel on the edges of the components, FIGS. 10, 11, 12, 13 & 14, are also selectable.

The edges of the triangular and square panels 32, 34, 36, & 38, as illustrated in FIGS. 1,7,8,& 9, are bevelled in for interfitting with adjacent panels and, as illustrated FIGS. 7,8,10,11,12,13, & 14, are preferably of lengths substantially equal to the edges of the panels. They are also of considerable cross-sectional size to be secure to the respective panels by adhesive, nailing or bolting. The edge members are ordinarily of wood which had been beveled to interfit with the adjacent panels, the techniques for such securement being well known.

Figure 2:
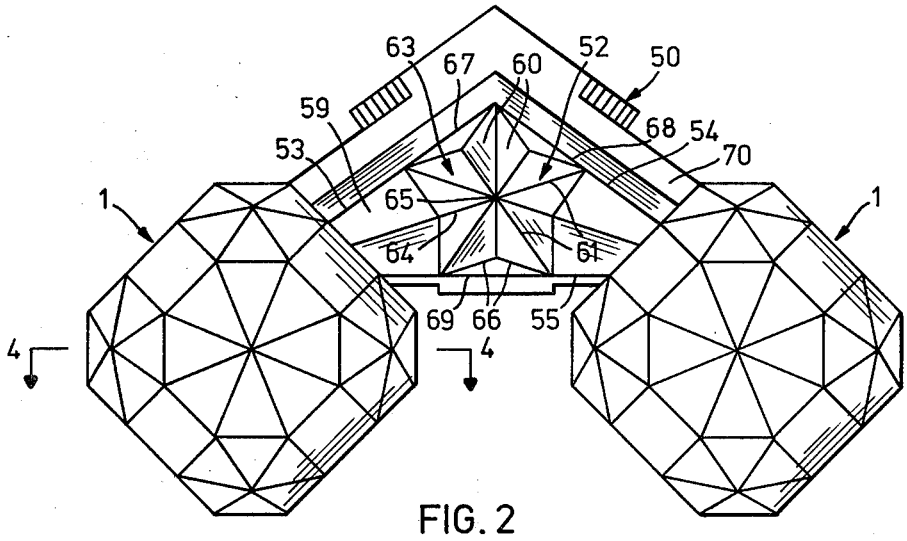
FIG. 2 is a top view of two primary buildings interconnected by one secondary, pentagonal building.
Figure 3:
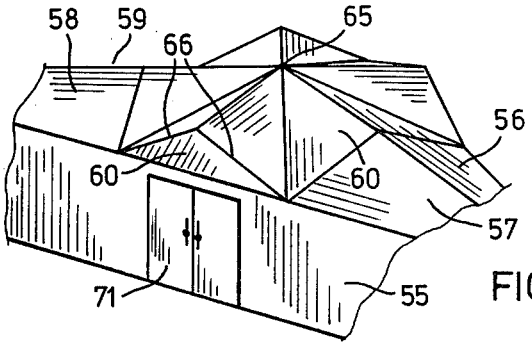
FIG. 3 is a perspective view of a secondary, pentagonal type building structure, partially shown.
Figure 4:
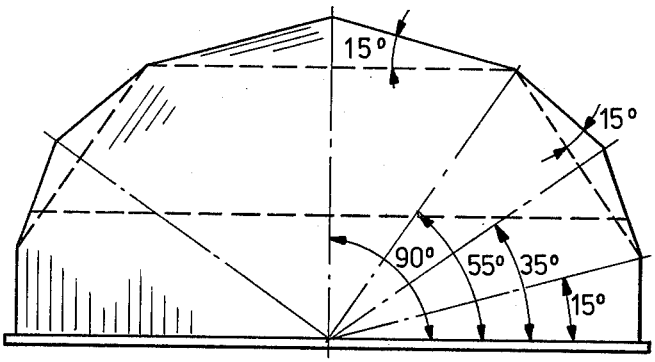
FIG. 4 is a side elevation view of a primary building structure.
Figure 5:
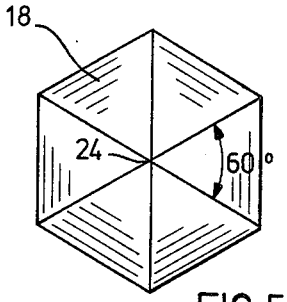
FIG. 5 is a top plan view of a hexagonal sub-assembly unit.

Two or more of the structures above described may be connected together to form a clustered structure. For example (not illustrated) two such structures may be connected so that a common upstanding wall (46) is shared by both. Another cluster embodiment is represented by FIGS. 2 and 3, which illustrate a connecting structure, 50, between two primary buildings (1). The structure 50 comprises a geodesic type roof structure, generally 52, wall units 53, 54, & 55, and roof units 56, 57, 58, & 59. The roof structure 52 may be constructed of fifteen identical isoceles triangular units 60. As illustrated, two of the triangular units 60 may be secured angularly together on their base edges 61 to create five paired units 63. The units 63 are secured together along edges 64 so as to share a common uppermost apex point 65, the edges 61 being upwardly disposed. The angle of securement of the edges 61 is selected so that leg edges 65 of each of the remaining five triangles 60 may be secured to adjacent leg edges of paired units 63. In this manner, the roof structure 52 is closed completely and the base edges of the unpaired triangles 60 form a regular pentagonal horizontal base for the roof structure 52. Wall units 53, 54, & 55 support the roof 52 along base edges 67, 68 and 69, respectively, and are secured to appropriate walls of the buildings 1 as shown. The walls are spanned by roof panels 56, 57, 58, & 59, a passageway between the buildings 1 being captured by the wall units, the roof units and a floor unit 70. Access doors 71 may be provided, in wall 55 for example.

It is clear that various clustered arrangements may be employed in addition to there herein described and/or illustrated, involving greater numbers of building 1, differing orientation thereof and differing means interconnecting the buildings without departing from the essential spirit of the present invention. The embodiments described and illustrated herein are for illustrative purposes only, and any embodiment within the bredth and scope of the appended claims is intended to be embraced herein.

I claim:

1. A geodesic type building having a self supporting shell, said shell comprising:

an uppermost equilateral regular octagonal sub-assembly unit having the peripheral edges thereof horizontal;

four identical equilateral regular hexagonal units, having peripheral edges equal in length to the peripheral edges of the octagonal unit, the hexagonal units being in upstanding quadripod arrangement, the lowermost edges thereof being each a chord of a horizontal circle defining the base plane of the shell and having a center directly below the geometric center of the octagonal unit, the upper edges of each hexagonal unit being secured to alternate edges of the octagonal unit;

four identical square panels each having one edge secured to an edge of the octagonal unit between two of the hexagonal units and having two opposing edges secured to adjacent edges of the two hexagonal units; and four identical isoceles trapezoidal units, the upper edge of each secured to the lower edge of the square units, the two opposing non-parallel edges of each secured to an edge of an adjacent hexagonal unit, the lower edge of the trapezoidal unit being a chord of the circle.

2. A building, comprising:

the geodesic building of claim 1;

four identical upstanding right rectangular shell side units each secured to the lower edge of one of the trapezoidal units and of equal length thereto; and four identical upstanding right rectangular shell corner units, an upper edge of each secured to a lower edge of one of the hexagonal units and the opposing edges of each secured to an adjacent side unit.

3. The building of claim 1, wherein:

each octagonal unit comprises eight identical isoceles triangular sub-units, each of the two equal edges of each sub-unit being secured to an edge of an adjacent sub-unit, so that the apices of the sub-units are together, the identical heights of the triangles of the sub-units being such that the octagonal unit is dished upwardly; and each hexagonal unit comprises six isoceles triangular sub-units, each of the two equal edges of each being secured to an edge of an adjacent sub-unit, so that the apices of the sub-units are together, the identical heights of the triangles of the sub-units being such that the hexagonal unit is dished.

4. The building of claim 2, wherein:

at least one of the side units is adapted to permit entry to the interior of the building: and at least one of the square panels is adapted to provide a dormer or other type window.

5. A cluster building comprising:

a first building according to claim 4;

a second building according to claim 4, erected in the proximity of the first building; and a connecting shell type structure capturing an enclosed passageway communicating between the entrances of the first and the second building, said structure having means of egress and ingress.

6. The cluster building of claim 5, wherein the connecting structure comprises:

a geodesic roof structure comprising fifteen identical isoceles triangles ten of which are arranged to form five identical pairs of the triangles, a leg edge of a triangle of each pair being secured angularly to a leg edge of the other triangle, the secured edges being upwardly disposed, and the base edge of each triangle in each pair being secured to a base edge of an adjacent paired triangle so that the five pairs have a common upwardly disposed apex, each leg edge of each of the remaining five triangles being secured to an adjacent leg of the triangles of adjacent pairs, the base edges of said remaining five triangles forming a regular pentagonal horizontal base of the roof unit;

a first upstanding planar wall unit secured to a first horizontal edge of the base of the roof structure, a vertical edge of the wall unit being secured also to an upstanding wall unit of the first building in the vicinity of the entrance thereto;

a second upstanding planar wall unit secured to a second horizontal edge of the base of the roof adjacent the first horizontal edge, being secured also to an adjacent edge of the first wall unit and at its opposite end to an upstanding wall unit of the second building in the vicinity of the entrance thereto;

a third upstanding planar wall unit secured to the third horizontal edge of the base of the roof opposite the first and second edges, being secured at one vertical end edge thereof to said upstanding wall unit of the first building and at its opposite vertical end edge to said upstanding wall unit of the second building, the entrance of the first building being between the first and third wall units and that of the second being between the second and third wall units; and roofing means closing the upper openings defined by the first, second and third wall units, said walls of the first and second buildings and the pentagonal roof structure.

* * * * *